United States Patent [19]

Galich

[11] 4,155,568

[45] May 22, 1979

[54] SECTIONAL SKI

[76] Inventor: Thomas P. Galich, 22672 Lambert St. #608, El Toro, Calif. 92630

[21] Appl. No.: 883,635

[22] Filed: Mar. 6, 1978

[51] Int. Cl.[2] ..... A63C 5/02

[52] U.S. Cl. ..... 280/603; 403/407

[58] Field of Search ..... 280/603, 601; 403/331, 403/334, 381, 409, 407

[56] References Cited

U.S. PATENT DOCUMENTS

| | | | |
|---|---|---|---|
| 792,979 | 6/1905 | Fulghum | 403/331 |
| 2,450,538 | 10/1948 | Beaudin | 280/603 |
| 3,104,888 | 9/1963 | Day et al. | 280/603 |
| 3,429,928 | 4/1969 | Noguchi | 280/603 |
| 3,797,838 | 3/1974 | Shurgot et al. | 280/603 |
| 3,819,198 | 6/1974 | Groves | 280/603 |
| 3,825,360 | 7/1974 | Galich | 280/603 X |

*Primary Examiner*—David M. Mitchell
*Assistant Examiner*—Milton L. Smith
*Attorney, Agent, or Firm*—Gary Appel

[57] ABSTRACT

A sectional ski having first and second ski sections with a first coupling member having a generally bar-shaped portion secured in endwise relation in a slot in the first ski section with the enlarged portion of the coupling member being contoured to form a part of the boot supporting region, the second ski section having a similarly configured coupling member secured thereto in endwise relation with the enlarged portions of the first and second coupling members having tapered tongue and groove portions matingly co-acting for locking the ski sections together.

12 Claims, 4 Drawing Figures

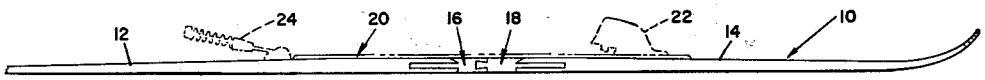

SECTIONAL SKI

BACKGROUND OF THE INVENTION

The background of the invention will be discussed in two parts:

1. Field of the Invention

This invention relates to skis and more particularly to a sectional ski.

2. Description of the Prior Art

Skis are normally rather lengthly and bulky objects and may be, for example, five to seven feet in length requiring that during the transportation of the skis in an automobile, if the automobile is of a compact variety or transporting a number of persons, a rack must be used on the exterior of the automobile for transporting the skis.

Skis have been developed in sections in an attempt to eliminate this key transportation problem. Some sectional ski devices are shown and described in U.S. Pat. Nos. 3,439,928; 3,797,838; 3,819,198; and 3,825,360. Another attempt utilizing a folding ski approach is shown and described in U.S. Pat. No. 2,450,538. In the sectional ski devices, the coupling members generally require machining in order to provide a very tight tolerance for fitting the parts together in order to give the ski stability in the longitudinal direction during use. Machining of mechanical parts increases the price due to the expense of the machining. In U.S Pat. No. 3,825,360, for example, the ski coupling member includes an elaborate dovetail arrangement with a transverse slot for receiving an insert which provides additional support for the joint and prevents undesired transverse flexing of the members of the joint. The particular configuration requires that the dovetails be machined with close tolerances, and furthermore due to the large number of dovetails, a corresponding increase in time is required.

Similarly with the sectional ski structure shown and described in U.S. Pat. No. 3,797,838, the coupling arrangement requires that one of the coupling members have a cavity formed therein for communicating with the edge for receiving a matingly contoured T-shaped bar portion on the other coupling portion with a fastening member engaging the coupling members on an axis generally parallel to the surface of the skis. The coupling arrangement likewise, requires cutting and machining to close tolerances.

The simplest coupling arrangement for a sectional ski shown in U.S. Pat. No. 3,819,198 has the coupling members engaging on a diagonal plane relative to the surface of the ski with dowel pins located on one of the coupling members for engaging aligned apertures in the other with suitable screw means fastening the members together along a plane generally perpendicular to the diagonal.

Accordingly, it is an object of the present invention to provide a new and improved sectional ski.

It is a further object of the invention to provide a sectional ski having new and improved coupling means.

It is a further object of this invention to provide a new and improved coupling member for use with a ski for joining two ski sections in endwise relation to form a unitary ski member.

SUMMARY OF THE INVENTION

The foregoing and other objects of the invention are accomplished by providing a sectional ski having first and second ski sections with a first coupling member having a bar-shaped portion insertable within a slot generally parallel to the surface of the ski and an enlarged portion which forms a continuation of the contour of the ski. A second coupling member of generally similar configuration is secured to the end of the other ski section with the enlarged portions of both coupling members having the end thereof configured to form tongue and groove means connectible by joining along a path of travel generally parallel to the plane of the surface of the ski. The coupling members are of cast configuration with a taper forming a wedge in the direction of insertion for locking the members together to thereby join the ski sections. Suitable fastening means may be provided for engaging the so coupled members together along a line generally perpendicular to the plane of the surface of the skis.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figures 1, 2, 3, 4:
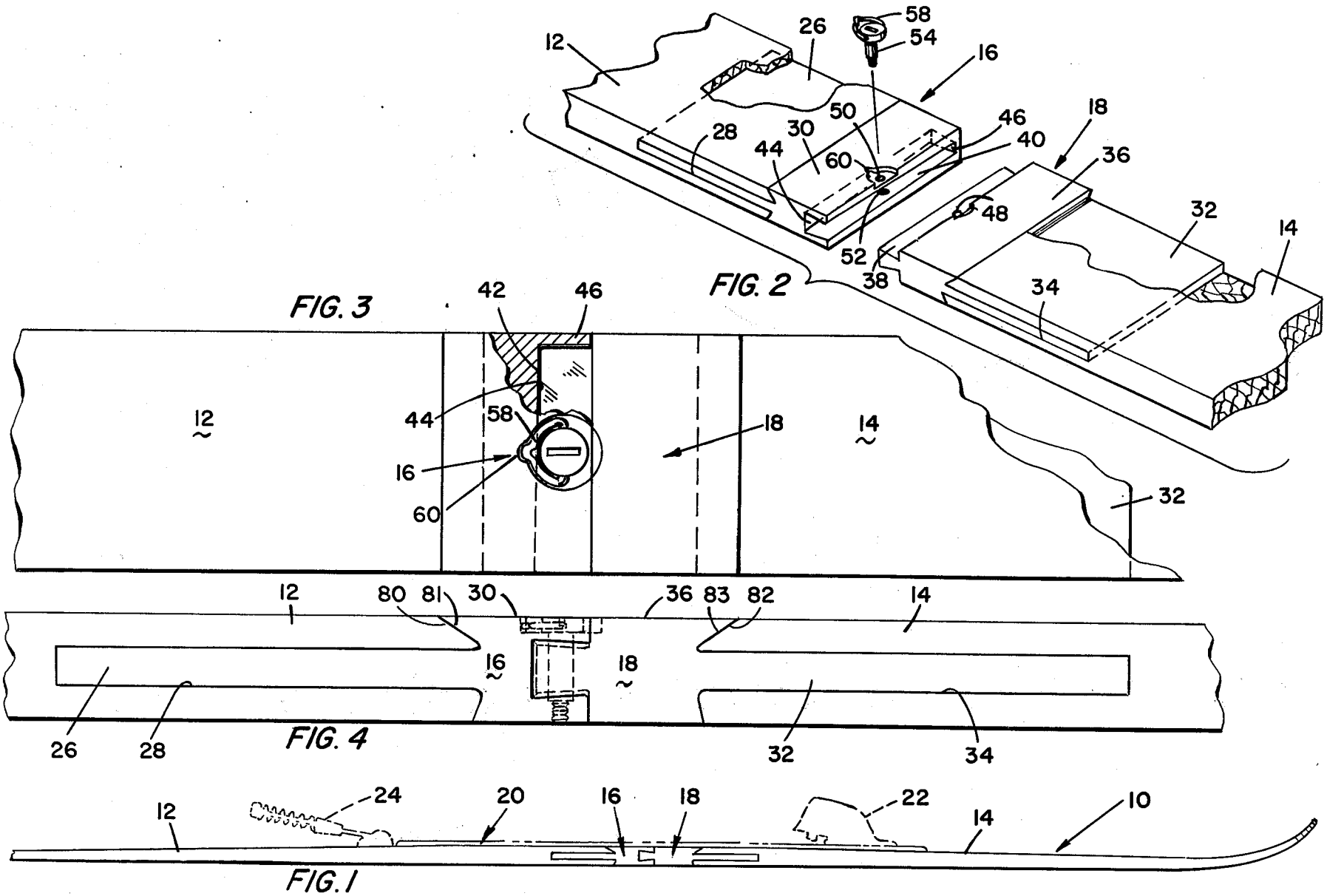
FIG. 1 is a side elevational view of a ski assembled in sections according to the invention.
FIG. 2 is a perspective view, partially broken away, and partially exploded showing the coupling members.
FIG. 3 is a plan view, partially broken away, showing the ski coupling portion in assembled relation.
FIG. 4 is a side elevational view of the structure of FIG. 3.

Referring now to the drawings and particularly to FIG. 1 there is shown an assembled sectional ski generally designated 10 formed from a first section 12 interconnected to a second section 14 by means of first and second coupling members generally designated 16 and 18. The upper surface of the ski 10 has a central portion immediately above the coupling members 16 and 18 which is the boot supporting portion 20 wherein a boot is retained between a toe piece 22 (shown in dotted line) and a releasable ski binding means 24 (also shown in dotted lines).

As better illustrated in FIGS. 2, 3, and 4, the first coupling member 16 has an elongated generally bar-shaped portion 26 insertable within a slot 28 with the bar-shaped portion 26 being disposed in generally parallel relation to the upper and lower surfaces of ski section 12. The bar-shaped portion 26 may be secured within slot 28 by any suitable means and the surface thereof may be suitably configured to assist in the securing. The other end of coupling member 16 is an enlarged portion 30 having upper and lower surfaces generally parallel to each other and configured to form a continuation of the contour of the upper surface and lower surface of the ski section 12. The other coupling member 18 is generally similarly configured with an elongated bar-shaped portion 32 secured within a slot 34 formed in the end of the second ski section 14, the coupling member 18 likewise having an enlarged portion 36 with the upper and lower surfaces thereof generally parallel to each other and generally co-extensive in contour with the upper and lower surfaces of second ski section 14 to form a continuation thereof. The overall width of the coupling members 16 and 18 is substantially identical to the width of the ski sections 12 and 14 with the overall height of the enlarged portions 30 and 36 being generally identical to the thickness of the ski sections 12 and 14 respectively.

The coupling members 16 and 18 are configured for connecting together end to end in tight fitting relation to provide the assembled ski 10 shown in FIG. 1. This interconnection is accomplished by means of a transversely extending tongue portion 38 formed in one end of the enlarged portion 36 of the coupling member 18 with the tongue 38 being configured for sliding engagement within a groove 40 formed in the end of the enlarged portion 30 of coupling member 16. The tongue 38 extends in a direction generally parallel to the upper and lower surfaces of the enlarged portion 36 and is located generally centrally with respect to the edge thereof. In side elevation, the tongue 38 is beveled so that the outer edge 42 thereof is deeper or thicker than the edge adjacent the connection with the enlarged portion 36. Similarly, the groove 40 extends along a line generally parallel to the upper and lower surfaces of ski section 12 with the inner surface 44 thereof deeper than the dimension between adjacent surfaces adjacent the edge thereof. In the transverse direction, that is along the length, the tongue 38 and groove 40 are tapered at approximately four to forty degrees to provide a wedge fitting when the tongue 38 is inserted within the groove 40 by sliding in a plane generally parallel to the plane of the surfaces of the ski with the leading enlarged end 42 of the tongue 38 in abutting engagement with the side 44 of the groove 40. To provide a positive stop during the insertion, the tongue 38 is slightly shorter than the overall width of the enlarged portion 36 of the coupling member 18, and the end of the groove 40 in the direction of insertion is provided with stop edge 46 for abuttingly engaging the shortened end of the tongue 38.

Centrally disposed within tongue 38 is an aperture 48 positioned for alignment after insertion with upper and lower apertures 50 and 52 respectively formed in the enlarged portion 30 of coupling member 16 in communication with the groove 40. The upper aperture 50 is countersunk about the periphery thereof for receiving the head of a shoulder screw 54 which passes therethrough, thence through aperture 48 of tongue 38, into threading engagement with the aperture 52 which is threaded. The threaded end of shoulder screw 54 is of slightly smaller diameter than the main body portion thereof.

In the preferred embodiment, the coupling members 16 and 18 are cast members with four to twenty degrees of taper of the mating co-acting tongue and groove members 38 and 40 respectively being within the tolerance of the mold during casting, thus providing coupling means integral with the coupling members 16 and 18 respectively with virtually no machining required which machining could tend to weaken the parts due to the application of heat and friction. Furthermore by utilizing this tolerance of the mold, the tongue 38 engages the groove 40 in relation in a wedge-shaped manner until the shortened end of tongue 38 abuts against the stop edge 46. The coupling members 16 and 18 are then joined by insertion of the shoulder screw 54 through aperture 50 through aperture 48 for threading engagement with aperture 52, the apertures 48 and 50 being precisely drilled to the diameter of the main body portion of shoulder screw 54 to provide a solid connection for joining together the ski sections 12 and 14 in the endwise abutting relation to form the unitary ski assembly 10 shown in FIG. 1.

Furthermore, it has been demonstrated in prototype production, that the captivity and adhesion of the ski sections 12 and 14 and coupling members 16 and 18 is enhanced by tapering their respectively opposing mating surfaces 80, 81 and 82, 83 in the range of 30 to 60 degrees as shown in FIG. 4. During handling and use, said taper strengthens the bonded joints 80, 81 and 82, 83 by lengthening the adhering cross-sectional surface area whereat bonding occurs and structural soundness is critical to good sectional ski design criteria.

In the preferred embodiment, an additional feature has been added to facilitate assembly and disassembly of respectively opposing ski sections, said feature being a ring 58 which is attached to the head of screw 54 and which folds down and fits into the aperture 60. The screw 58 is provided with an anti-rotation tang so as to lock screw 54 in its fully inserted position after the screw is fully screwed in place.

While there has been shown and described a preferred embodiment it is to be understood that other adaptations and modifications may be made within the spirit and scope of the invention, such as the invention's application as to surfboards and other apparatus of relatively long length with attendant awkwardness of portage. What is claimed is:

1. A sectional ski comprising:

first and second ski sections;

a first coupling member having a generally bar-shaped portion and an enlarged portion, said bar-shaped portion being secured in endwise relation in a slot in said first ski section, said enlarged portion having upper and lower surfaces contoured to form a part of said first ski section;

a second coupling member having a generally bar-shaped portion and an enlarged portion, said bar-shaped portion being secured in endwise relation in a slot in said second ski section, said enlarged portion having upper and lower surfaces generally forming a part of the surfaces of said second ski section;

mating transversely extending tongue and groove means formed in the ends of said enlarged portions of said first and second coupling members, said tongue and groove means extending in a plane generally parallel to the surface of said ski sections for connecting said first and second ski sections in endwise abutting relation by inserting said tongue means into said groove means and sliding said coupling members relative to each other in said plane; and means co-acting with said tongue and groove means for locking said first and second coupling members together.

2. The combination according to claim 1 wherein said tongue and groove means are contoured for insertion to form a mating wedge-type connection.

3. The combination according to claim 2 wherein said tongue and groove means are contoured in the direction of insertion to form a wedge connection.

4. The combination according to claim 3 wherein said tongue and groove means are tapered in the direction of insertion to form a wedge connection.

5. The combination according to claim 4 wherein said groove means include stop means and said tongue is configured for abutting engagement with said stop means.

6. The combination according to claim 5 wherein the enlarged portions of said first and second coupling members form a part of the boot supporting surface of said ski.

7. The combination according to claim 6 wherein said means co-acting with said tongue and groove means include a screw member passing through said tongue and groove means in a direction generally perpendicular to the plane of the surface of said ski.

8. The combination according to claim 7 wherein said first and second coupling members are cast metal.

9. The combination according to claim 8 wherein said tongue and groove means are tapered substantially in the range of one-half to forty degrees.

10. The combination according to claim 8 wherein said first and second coupling members, respectively, at the juncture of said bar-shaped portions and enlarged portions, form an upper and lower inwardly angled surface for retaining and capturing said ski section.

11. The combination according to claim 10 wherein said upper angled surface is inclined inwardly in the range of 30 to 60 degrees.

12. The combination according to claim 7 wherein said first and second coupling members are tool machined.

* * * * *